US008707847B2

(12) United States Patent
Wang et al.

(10) Patent No.: US 8,707,847 B2
(45) Date of Patent: Apr. 29, 2014

(54) POLLUTION-FREE LIQUID BALANCING DEVICE

(71) Applicant: Beijing Mechanical Equipment Institute, Beijing (CN)

(72) Inventors: Shengjie Wang, Beijing (CN); Yajun Chen, Beijing (CN); Xuyang Qiu, Beijing (CN); Aifeng Chen, Beijing (CN); Yulong Tang, Beijing (CN); Shuyong Han, Beijing (CN)

(73) Assignee: Beijing Mechanical Equipment Institute, Beijing (CN)

( * ) Notice: Subject to any disclaimer, the term of this patent is extended or adjusted under 35 U.S.C. 154(b) by 0 days.

(21) Appl. No.: 14/011,729

(22) Filed: Aug. 27, 2013

(65) Prior Publication Data

US 2014/0007758 A1 Jan. 9, 2014

Related U.S. Application Data

(63) Continuation of application No. PCT/CN2011/076565, filed on Jun. 29, 2011.

(51) Int. Cl.
*F41A 1/10* (2006.01)

(52) U.S. Cl.
USPC ..... 89/1.701

(58) Field of Classification Search
CPC ..... F41A 1/08; F41A 1/10
USPC ..... 89/1.7, 1.701, 1.702; 42/1.06; 102/437
See application file for complete search history.

(56) References Cited

U.S. PATENT DOCUMENTS

| | | | | |
|---|---|---|---|---|
| 3,800,656 | A * | 4/1974 | Schnabele | 89/1.701 |
| 4,498,368 | A | 2/1985 | Doane | |
| 5,099,764 | A * | 3/1992 | Dale et al. | 102/374 |
| 5,551,330 | A * | 9/1996 | Reuche | 89/1.701 |
| 5,617,664 | A * | 4/1997 | Troncoso | 42/1.06 |
| 7,353,739 | B2 * | 4/2008 | Ax et al. | 89/1.701 |
| 2005/0115392 | A1 * | 6/2005 | Franzen et al. | 89/1.701 |

(Continued)

FOREIGN PATENT DOCUMENTS

| | | | |
|---|---|---|---|
| CN | 2614682 | Y | 5/2004 |
| CN | 101088859 | A | 12/2007 |

(Continued)

*Primary Examiner* — Bret Hayes
(74) *Attorney, Agent, or Firm* — Syncoda LLC; Feng Ma

(57) ABSTRACT

A pollution-free liquid balancing device comprises a sealing bag (1), a front cover (2), a rear cover (3) and liquid balancing matter (4), wherein the sealing bag (1), the front cover (2) and the rear cover (3) are all plastic material. The sealing bag (1) is filled with the liquid balancing matter (4) inside, and plastically sealed under high temperature at both ends. The diameters of the front cover (2) and the rear cover (3) are matched with the inner diameter of a launch barrel (5), and the sealing bag (1) is provided between the front cover (2) and the rear cover (3). In an ordinary transportation state, the liquid balancing matter (4) is well sealed in the sealing bag (1), and a missile is launched forward by the propulsion of powder during launch, the sealing bag (1), the front cover (2) and the rear cover (3) crack instantaneously, and the liquid balancing matter (4) is ejected backward outside the barrel at high speed. The forward and backward impulses are similar or equal, thereby reducing or eliminating the impulse to the launch barrel (5) during launch. The device has a simple structure and uses the pollution-free liquid balancing matter (4), thus there is no pollution after launch.

1 Claim, 1 Drawing Sheet

(56) References Cited

U.S. PATENT DOCUMENTS

| | | | | |
|---|---|---|---|---|
| 2005/0217468 | A1* | 10/2005 | Ax et al. | 89/1.704 |
| 2005/0235816 | A1* | 10/2005 | Franzen et al. | 89/1.701 |
| 2010/0031809 | A1* | 2/2010 | Lantz et al. | 89/1.702 |
| 2010/0282054 | A1* | 11/2010 | Ax et al. | 89/1.701 |
| 2010/0282057 | A1* | 11/2010 | Rapp et al. | 89/14.3 |
| 2011/0296977 | A1* | 12/2011 | Regebro | 89/1.701 |

FOREIGN PATENT DOCUMENTS

| | | | |
|---|---|---|---|
| CN | 101501441 | A | 8/2009 |
| CN | 201284005 | Y | 8/2009 |
| CN | 201297896 | Y | 8/2009 |

* cited by examiner

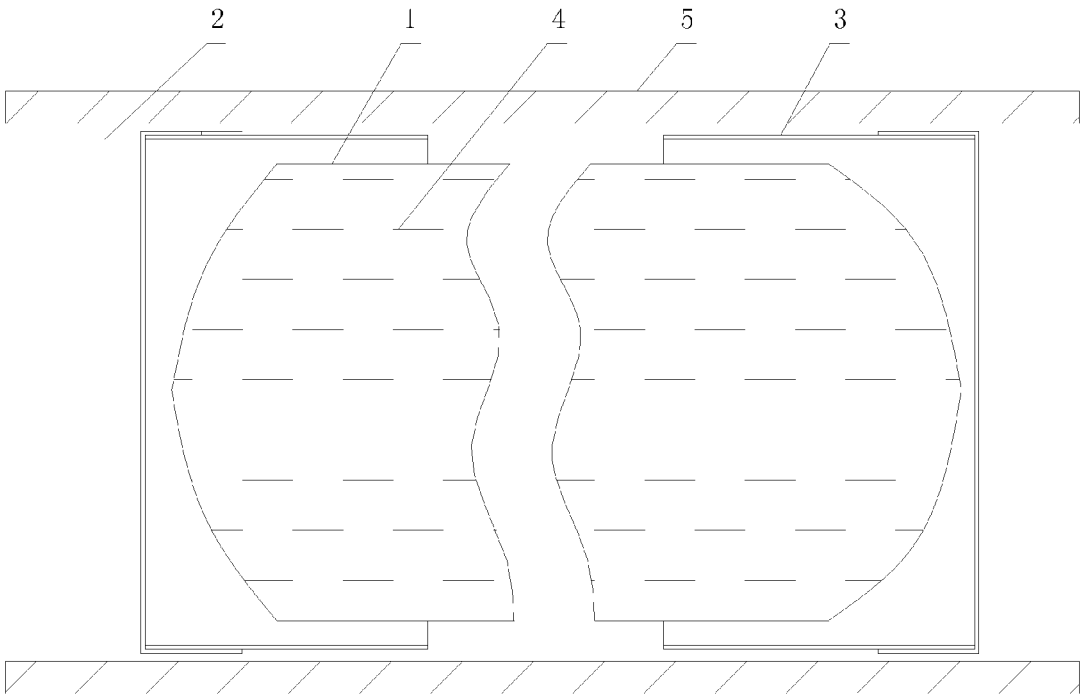
2
1
4
5
3

POLLUTION-FREE LIQUID BALANCING DEVICE

CROSS-REFERENCE TO RELATED APPLICATIONS

The present application is a continuation of PCT/CN2011/076565, filed Jun. 29, 2011, the disclosure of which is hereby incorporated by reference in its entirety.

BACKGROUND

The present invention relates to a balancing device, more particularly to a pollution-free liquid balancing device.

The current balancing device consists of plastic sheets and guide strips. Most of the balancing device consists of plastic sheets, and guide strips play a role to limit and guide the plastic sheets. The balancing device is placed in a launch barrel. When a missile is launched forward by the propulsion of powder during launch, the balancing device is ejected backward at high speed, the forward and backward impulses are equal, thereby eliminating the impulse to the launch barrel. The disadvantage of this balancing device is that the plastic sheets are spread into a large range, difficult to recovery, and cause great pollution to the environment.

SUMMARY

The present invention is aimed to provide a pollution-free balancing device, to solve a problem that the plastic sheets of the current missile balancing device are spread into a large range, difficult to recovery, and cause great pollution to the environment.

A pollution-free liquid balancing device comprises a sealing bag, a front cover, a rear cover and liquid balancing matter, wherein the sealing bag, the front cover and the rear cover are all plastic material, the liquid balancing matter comprises: water, anti-corrosion additives, antifreeze agents and inorganic salts. The mass of the liquid balancing matter is 1~1.5 times that of the launch matter, the anti-corrosion additives and the antifreeze agents are liquid or soluble substances and do not react chemically with the sealing bag, the inorganic salts are also soluble substances and do not react chemically with the sealing bag, and the solubility is stable in the case of temperature changes. The sealing bag is filled with the liquid balancing matter, and plastically sealed under high temperature at both ends. The diameters of the front cover and the rear cover are matched with the inner diameter of a launch barrel, and the sealing bag is provided between the front cover and the rear cover.

The anti-corrosion additives are used to adjust the PH of the liquid balancing matter, the anti-freeze agents are used to reduce the freezing point of the liquid balancing matter, and the inorganic salts are used to increase the density of the liquid balancing matter. In an ordinary transportation state, the liquid balancing matter is well sealed in the sealing bag. When a missile is launched forward by the propulsion of powder during launch, the sealing bag, the front cover and the rear cover crack instantaneously, and the liquid balancing matter is ejected backward outside the barrel at high speed, the forward and backward impulses are similar or equal, thereby reducing or eliminating the impulse to the launch barrel.

The device has a simple structure and uses the liquid balancing matter as balancing matter, thus there is no pollution after launch.

BRIEF DESCRIPTION OF THE DRAWINGS

FIG. 1 is structure diagram of a pollution-free balancing device.

1. Sealing bag;
2. Front cover;
3. Rear cover;
4. Liquid balancing matter;
5. Launch barrel

DETAILED DESCRIPTION

A pollution-free liquid balancing device, comprises: a sealing bag 1, a front cover 2, a rear cover 3 and liquid balancing matter 4, wherein the sealing bag 1, the front cover 2 and the rear cover 3 are all plastic material. The liquid balancing matter 4 comprises: water, anti-corrosion additives, antifreeze agents and inorganic salts, the mass of the liquid balancing matter is 1.5 times that of the launch matter, the anti-corrosion additives and the antifreeze agents are liquid or soluble substances, which do not react chemically with the sealing bag, the inorganic salts are also soluble substances, which do not react chemically with the sealing bag, and have stable solubility in the case of temperature changes. The sealing bag 1 is filled with the liquid balancing matter 4 and plastically sealed under high temperature at both ends, the diameters of the front cover 2 and the rear cover 3 are matched with the inner diameter of a launch barrel 5, and the sealing bag 1 is provided between the front cover 2 and the rear cover 3.

The anti-corrosion additives are used to adjust the PH of the liquid balancing matter, the anti-freeze agents are used to reduce the freezing point of the liquid balancing matter, the inorganic salts are used to increase the density of the liquid balancing matter. In an ordinary transportation state, the liquid balancing matter 4 is well sealed in the sealing bag 1. When a missile is launched forward by the propulsion of powder during launch, the sealing bag 1, the front cover 2 and the rear cover 3 crack instantaneously, and the liquid balancing matter 4 is ejected backward outside the barrel at high speed, the forward and backward impulses are similar or equal, thereby reducing or eliminating the impulse to the launch barrel 5.

A pollution-free liquid balancing device, comprises: a sealing bag 1, a front cover 2, a rear cover 3 and liquid balancing matter 4, wherein the sealing bag 1, the front cover 2 and the rear cover 3 are all plastic material. The liquid balancing matter 4 comprises: water, anti-corrosion additives, antifreeze agents and inorganic salts, the mass of the liquid balancing matter is 1.5 times that of the launch matter, the anti-corrosion additives and the antifreeze agents are liquid or soluble substances, which do not react chemically with the sealing bag, the inorganic salts are also soluble substances, which do not react chemically with the sealing bag, and have stable solubility in the case of temperature changes. The sealing bag 1 is filled with the liquid balancing matter 4 and plastically sealed under high temperature at both ends, the diameters of the front cover 2 and the rear cover 3 are matched with the inner diameter of a launch barrel 5, and the sealing bag 1 is provided between the front cover 2 and the rear cover 3.

The anti-corrosion additives are used to adjust the PH of the liquid balancing matter, the anti-freeze agents are used to reduce the freezing point of the liquid balancing matter, the inorganic salts are used to increase the density of the liquid balancing matter. In an ordinary transportation state, the liquid balancing matter 4 is well sealed in the sealing bag 1.

When a missile is launched forward by the propulsion of powder during launch, the sealing bag 1, the front cover 2 and the rear cover 3 crack instantaneously, and the liquid balancing matter 4 is ejected backward outside the barrel at high speed, the forward and backward impulses are similar or equal, thereby reducing or eliminating the impulse to the launch barrel 5.

The device has a simple structure and uses the liquid balancing matter as balancing matter, thus there is no pollution after launch.

The invention claimed is:

1. A pollution-free liquid balancing device, characterized in that the device comprises: a sealing bag (1), a front cover (2), a rear cover (3) and liquid balancing matter (4), wherein the sealing bag (1), the front cover (2) and the rear cover (3) are all plastic material, the liquid balancing matter (4) comprises: water, anti-corrosion additives, antifreeze agents and inorganic salts; the mass of the liquid balancing matter (4) is 1~1.5 times that of launch matter, the anti-corrosion additives and the antifreeze agents are liquid or soluble substances and do not react chemically with the sealing bag, the inorganic salts are also soluble substances and do not react chemically with the sealing bag, and the solubility is stable during temperature changes; the sealing bag (1) is filled with the liquid balancing matter (4) and plastically sealed under high temperature at both ends, diameters of the front cover (2) and the rear cover (3) are matched with an inner diameter of a launch barrel (5), and the sealing bag (1) is provided between the front cover (2) and the rear cover (3);

the anti-corrosion additives are used to adjust the PH of the liquid balancing matter, the anti-freeze agents are used to reduce the freezing point of the liquid balancing matter, the inorganic salts are used to increase the density of the liquid balancing matter, in an ordinary transportation state, the liquid balancing matter (4) is well sealed in the sealing bag (1), when a missile is launched forward by propulsion of powder during launch, the sealing bag (1), the front cover (2) and the rear cover (3) crack instantaneously, and the liquid balancing matter (4) is ejected backward outside the barrel at high speed, forward and backward impulses are similar or equal, thereby reducing or eliminating the impulse to the launch barrel (5).

* * * * *